US010702432B2

(12) United States Patent
Goodes et al.

(10) Patent No.: US 10,702,432 B2
(45) Date of Patent: Jul. 7, 2020

(54) BATHING APPARATUS

(71) Applicant: GAINSBOROUGH HEALTHCARE GROUP LIMITED, Worcestershire (GB)

(72) Inventors: Dennis Goodes, Aycliffe (GB); Sean O'Malley, Aycliffe (GB)

(73) Assignee: GAINSBOROUGH HEALTHCARE GROUP LIMITED, Worcestershire (GB)

( * ) Notice: Subject to any disclaimer, the term of this patent is extended or adjusted under 35 U.S.C. 154(b) by 0 days.

(21) Appl. No.: 15/982,334

(22) Filed: May 17, 2018

(65) Prior Publication Data

US 2019/0350789 A1 Nov. 21, 2019

(51) Int. Cl.
*A61G 7/10* (2006.01)

(52) U.S. Cl.
CPC ..... *A61G 7/1003* (2013.01); *A61G 7/1059* (2013.01)

(58) Field of Classification Search
CPC ..... A61G 7/1003
USPC ..... 4/565.1
See application file for complete search history.

(56) References Cited

U.S. PATENT DOCUMENTS 5,527,095 A * 6/1996 Marshall ..... A47C 1/0352 297/258.1
2016/0207487 A1* 7/2016 Li ..... B60N 2/2227

FOREIGN PATENT DOCUMENTS

| | | | |
|---|---|---|---|
| DE | 8902333 | U1 | 11/1989 |
| DE | 29603125 | U1 | 4/1996 |
| DE | 19925137 | C1 | 2/2001 |
| EP | 0578947 | A1 | 1/1994 |
| EP | 2500006 | A2 | 9/2012 |
| FR | 2265334 | A1 | 10/1975 |
| GB | 2511352 | A | 9/2014 |

* cited by examiner

*Primary Examiner* — Christine J Skubinna
(74) *Attorney, Agent, or Firm* — Alston & Bird LLP

(57) ABSTRACT

A seat lift for a bath that includes a seat, a seat back hingedly connected to the seat, a torsion spring, and a guide means for guiding the seat in reversible movement between lower and upper positions. The guide means is configured so that movement between the lower and upper positions comprises both vertical and lateral movement of the seat relative to a base of the bath. The seat back may move between a first seat back position in which the seat back is substantially upright and a second seat back position in which the seat back is orientated so that a user is leaning backwards. The torsion spring biases the seat back to rotate around the hinge connecting the seat back to the seat toward the first seat back position. The torsion spring torque is smaller when the seat is in the lower position than in the upper position.

12 Claims, 4 Drawing Sheets

BATHING APPARATUS

This invention relates to bathing apparatus, in particular, to apparatus for bathing for use by the elderly, infirm or other users with mobility problems.

It is known that one method available to humans for washing their body is to use a bath, sometimes known as a bathtub. A standard bath is essentially a container suitable for containing water which is of sufficient size to allow a human to at least partially immerse themselves in any water held within the bath. The bath generally comprises a base and one or more side walls extending from the base in a generally upward direction (when the bath is orientated for use), the number of side walls being dependent on the shape of the base. The upper edges of the side walls (when the bath is orientated for use) collectively define an open mouth. Access to the water is generally gained by a user climbing through the mouth and into any water held within the bath. All further description of the structure of baths generally and/or baths of the present invention and/or apparatus according to the present invention for use in association with baths will be made on the basis that the bath is orientated for use. That is the base of the bath is the vertically lowermost of the bath base and the side wall or walls.

For some users of baths, such as the elderly, infirm and or those with mobility problems, a standard bath as just described is difficult and/or unsafe and/or impossible to use because to use the bath the user must be able to climb into the bath and lower themselves into the water. They must then, subsequently be able to raise themselves out of the water and climb out of the bath. For the elderly, infirm and or those with mobility problems, such acts can be difficult, if possible at all.

It is known to provide baths which have a door in the or one of the side walls, that door being sealable so that when it is in a closed position the bath is capable of retaining water. When the bath is empty, the door can be moved to an open position and a user can walk through the aperture created in the side wall. This overcomes the need for a user to lower themselves through the mouth of the bath, and can be much easier for a user who is elderly, infirm and or with mobility problems to use.

It is also known to provide a seat lift. A seat lift is generally comprised of a seat and, optionally, a seat back together with a mechanism that can move the seat, and seat back if present, vertically between an upper position in which it is relatively easy for a user to sit on the seat, and a lower position in which the seat, and seat back if present, are wholly or substantially within the volume defined by the bath base and side wall or walls and may be at least partially submerged in any water retained within the bath.

The mechanism of a known seat lift is generally an X frame leading to a substantially vertical movement of the seat between the upper and lower positions.

The control and or powering of the movement of the seat upwards or downwards between the upper and lower positions is by a suitable control and/or power means. Such a seat lift can be of considerable assistance to a user who has difficulty in lowering themselves into a bath or rising from a bath.

According to a first aspect of the present invention there is provided a seat lift for use in association with a bath comprising a bath base and at least one side wall, the seat lift comprising a seat, a seat back hingedly connected to the seat, a torsion spring, and a guide means adapted to guide the seat in reversible movement between a lower position in which the seat is close to the bath base and an upper position in which the seat is remote from the bath base characterised in that the guide means is configured so that movement of the seat between the lower and upper positions comprises both vertical and lateral movement of the seat relative to the base of the bath;

the seat back may move between a first seat back position in which the seat back is substantially upright and a second seat back position in which the seat back is orientated relative to the seat so that a user sitting on the seat and with their back on the seat back is leaning backwards;

the torsion spring biases the seat back to rotate around the hinge connecting the seat back to the seat toward the first seat back position;

the torque exerted by the torsion spring is smaller when the seat is in the lower position than when the seat is in the upper position.

The advantage of seat lifts comprising both a seat and a seat back is that the user may lean against the back and gain considerable stability thereby.

The use of a torsion spring to bias the seat back into the first seat back position is that the seat back can assist a user sit substantially upright if they need such assistance. Further, the biasing has the effect that the seat back is not unyielding when a user sits in it. This means that when a user sits on the seat and leans on the seat back the seat back may, dependent on the force exerted by the user on the seat back, rotate a little about the hinge that connects it to the seat absorbing the force of the user on the seat back. The torque exerted by the torsion spring may, when the force of the user leaning on the seat back is dissipated, bias the seat back towards the first seat back position helping the user sit substantially upright.

When the seat and seat back are in the lower position the user of the seat lift may want to lie back into water that is in the bath. The lower torque exerted by the torsion spring relative to the torque at the upper position may allow the user to lie back with relative ease and without the need for significant strength.

In some embodiments of the present invention the torque exerted by the torsion spring when the seat and seat back are in the lower position may be set to a predetermined value.

In some embodiments of the present invention means may be provided to allow the torque exerted by the torsion spring when the seat and seat back are in the lower position to be altered by a user or other person. The value to which the torque is adjusted may, at least in part, be determined by one or more physical characteristics of the user. Such characteristics may include but not be limited to the weight, strength, and or height of the user. This has the effect that the amount of force a user needs to exert to push the seat back into the second seat back position may be configured to suit the user of the seat lift.

It is preferred that if the bath base has a longitudinal extent the lateral movement of the seat is substantially in the direction of that longitudinal extent. It is known for baths to have a bath base that is approximately rectangular or stadium shaped. In such instances, it is preferred that the lateral movement of the seat is substantially parallel to the longitudinal axis of the bath base.

In some embodiments of the invention when the seat back is in the first seat back position the angle between the seat and the seat back is between around 90° and around 115°, between around 90° and around 110°, between around 95° and around 110°, or between around 100° and around 110°.

In some embodiments of the present invention when the seat back is in the second seat back position the angle between the seat and the seat back is between around 115° and around 180°, between around 110° and around 180°, between around 110° and around 160°, or between around 110° and around 140°.

In some embodiments of the present invention, the seat lift is so configured that the movement of the seat and seat back from the upper position to the lower position causes the torque exerted by the torsion spring to be reduced and movement of the seat and seat back from the lower position to the upper position causes the torque exerted by the torsion spring to increase.

In some embodiments of the present invention, the seat lift is so configured that the torsion spring interacts with the bath base when the seat is less than a predetermined distance from the bath base. Such interaction may be the result of a direct contact between the bath base and the torsion spring. Alternatively, the interaction may be indirect, that is via one or more mechanical elements such as, but not exclusively, arms, levers or pivots. In some embodiments, the torsion spring may be adjusted by appropriate means dependent upon the proximity of the seat to the bath base.

In some embodiments of the present invention, there is a linear relationship between the position of the seat and seat back between the lower and upper positions and the position of the seat back between the second and first seat back positions. For example, when the seat and seat back are in the lower position the seat back is in the second seat back position, when the seat and seat back are a proportion of the distance between the lower and upper positions the seat back is the same proportion of the angular distance between the second and first seat back positions, and when the seat and seat back are in the upper position the seat back is in the first seat back position.

In other embodiments, the relationship between the position of the seat and seat back between the lower and upper positions and the position of the seat back between the second and first seat back positions is non-linear, albeit that when the seat and seat back are in the lower position the seat back is in the second seat back position, and when the seat and seat back are in the upper position the seat back is in the first seat back position.

In other embodiments, commencement of movement of the seat back between the second and first seat back positions is allowed or caused when the seat and seat back reaches or passes through a predetermined position between the lower and upper positions. The predetermined position may be different depending on whether the seat and seat back is moving from the lower position to the upper position or from the upper position to the lower position. In some such embodiments, until the seat and seat back reaches or passes through the predetermined position the seat back is held or locked in the seat back position it occupied before the seat and seat back started to move toward the predetermined position.

In some embodiments, when the seat and seat back moves from the upper position to the lower position the predetermined position between the upper and lower positions at which movement of the seat back from the first seat back position to the second seat back position is allowed or caused is less than 10 cm, less than 8 cm, less than 6 cm, less than 4 cm or less than 2 cm from the lower position. In some such embodiments, until the seat and seat back reaches or passes through the predetermined position the seat back is held or locked in the first seat back position.

In some embodiments, when the seat and seat back moves from the lower position to the upper position the predetermined position between the lower and upper positions at which movement of the seat back from the second seat back position to the first seat back position is allowed or caused is less than 10 cm, less than 8 cm, less than 6 cm, less than 4 cm or less than 2 cm from the lower position. In some such embodiments, until the seat and seat back reaches or passes through the predetermined position the seat back is held or locked in the second seat back position, and once the seat and seat back has passed through the predetermined position or shortly thereafter the seat back is held or locked in the first seat back position.

In some embodiments of the present invention, there is a linear relationship between the position of the seat and seat back between the lower and upper positions and the amount of torque exerted by the torsion spring with the maximum amount of torque being exerted when the seat and seat back are in the upper position and the minimum amount of torque being exerted when the seat and seat back are in the lower position.

In other embodiments, the relationship between the position of the seat and seat back between the lower and upper positions and the amount of torque being exerted by the torsion spring is non-linear, albeit that the maximum amount of torque is exerted by the torsion spring when the seat and seat back are in the upper position and the minimum amount of torque being exerted by the torsion spring when the seat and seat back are in the lower position.

In some embodiments, a change in the amount of torque that is exerted by the torsion spring occurs when the seat and seat back reaches or passes through a predetermined position between the lower and upper positions. The predetermined position may be different depending on whether the seat and seat back is moving from the lower position to the upper position or from the upper position to the lower position.

In some embodiments, when the seat and seat back moves from the upper position to the lower position the predetermined position between the upper and lower positions at which a change in the amount of torque that is exerted by the torsion spring is commenced is less than 10 cm, less than 8 cm, less than 6 cm, less than 4 cm or less than 2 cm from the lower position.

In some embodiments, when the seat and seat back moves from the lower position to the upper position the predetermined position between the lower and upper positions at which a change in the amount of torque that is exerted by the torsion spring is commenced is less than 10 cm, less than 8 cm, less than 6 cm, less than 4 cm or less than 2 cm from the lower position.

The position of the seat and seat back between the lower position and upper position may be determined by sensors or by physical interference or interaction between the seat and/or seat back and the guide means, or interference or contact between the seat and/or seat back and/or a mechanism mounted directly or indirectly on the seat or seat back and the bath in which the seat lift of the present invention is used.

In some embodiments of the present invention seat back is biased toward the first seat back position and when the seat and seat back are in the lower position the bias toward the first seat back position is relatively light allowing the seat back to move into the second seat back position. In such an embodiment, the bias toward the first seat back position may increase when the seat and seat back starts to move away from the lower position toward the upper position.

In some embodiments of the invention the torsion spring is a dual torsion spring. The torsion spring is preferably of a material that will not be damaged by regular immersion in water.

In some embodiments of a seat lift according to the present invention the seat lift further comprises a tilting lever, in which the tilting lever is fixed to the seat back and a contact portion of the tilting lever extends below the seat. The tilting lever is preferably so configured that the contact portion of the tilting lever is spaced from the seat when the seat back is in the first seat back position and movement of the contact portion of the tilting lever to move toward the seat causes movement of the seat back from the first seat back position toward the second seat back position.

The hinge between the seat back and the seat and/or the tilting lever may be so configured to allow hinging of the seat back relative to the seat only between the first and second seat back positions.

The hinged connection between the seat back/tilting lever assembly and the seat may comprise a biasing means biasing the seat back towards the first seat back position. The biasing means may be a torsion spring or a mechanical equivalent thereof.

The contact portion of the tilting lever may comprise one or more contact means adapted to contact the base of the bath without causing damage to the surface of the bath base. It is preferred that the contact means are adapted to move across the surface of the bath base without causing damage to the bath base. In some preferred embodiments of the present invention, the contact means may comprise one or more rollers or pads of material softer than the surface of the bath base.

The seat of the seat lift of the present invention may be a rigid seat or a non-rigid seat. It is preferred but not essential that a non-rigid seat is associated with a rigid seat frame. It is preferred that the seat of the seat lift of the present invention is of a material that is not damaged by repeated immersion in water.

A seat lift of the present invention may further comprise at least one arm rest. In some preferred embodiments of the present invention the bath seat comprises two arm rests arranged so that a user sitting on the seat is between the arm rests.

In some embodiments of the present invention at least one arm rest is fixed in position relative to the seat and or the seat back. In other embodiments of the present invention at least one arm rest is pivotably attached to the seat or the seat back. In other embodiments of the present invention at least one arm rest is in sliding engagement with the seat or the seat back.

In some embodiments of the present invention at least one arm rest is or may be so positioned that when the seat and seat back is in the lower position the or each arm rest is wholly or substantially adjacent to a side wall of a bath with which the bath seat is being used. In such embodiments, it is preferred that when the seat and seat back moves from the lower position to the upper position the or each arm rest moves so that the user has lateral support from the or each arm rest, even when the or each arm rest is above the upper edge of the side wall or walls of the bath.

According to a second aspect of the present invention there is provided a seat lift according to the first aspect of the present invention which is integral with a bath comprised of a bath base and at least one side wall.

In some embodiments of the second aspect of the present invention the guide means of the seat lift are attached to, integral with, and/or defined by one or two side walls of the bath. In some such embodiments, the guide means may be comprised of at least one channel each of which is defined by or attached to a bath wall and within which one or more guide rails or guide tracks are provided, and the seat and or seat back are provided with means for directly or indirectly interacting with the walls of the channel and or each guide rail or track.

The interaction means may be caused to move along the channel or guide rail or track by suitable means. Such suitable means may comprise, without limitation, one or more of a drive belt, helical screw, chain, and or other equivalent mechanical power or movement transmission means.

In other embodiments, the guide means may comprise one or more actuators, rams or their mechanical equivalent and one or more stabilising rods in which the or each stabilising rod is associated with a bush or bearing fixed to a side wall of a bath or onto a rigid frame onto which the side walls of the bath are also fixed. The actuators, rams or their mechanical equivalent are preferably linear and are adapted to move the seat between the lower and upper positions.

In some embodiments of the second aspect of the present invention bath further comprises a door through a side wall of the bath. The door is preferably of dimensions suitable to allow a user to walk into the bath. It is preferred in such embodiments that the seat lift is so located relative to the bath and the door that when the seat and seat back are in the upper position the user can sit on the seat once the user has walked into the bath through the door with no or minimal travel of the user across the surface of the bath base. Such an arrangement is particularly beneficial because it avoids the user having to move around within the bath more than is necessary thus minimising the risk of slipping within the bath.

In such arrangements it is preferred that the guide means are so configured and orientated that when the seat and seat back move toward the lower position the seat and seat back/user is moved away from the door. This allows the door to be located toward a corner of the bath if the bath has a bath base of approximately rectangular or stadium shaped base. This position is a strong position to site a door in a bath wall.

The present invention will be further described and explained by way of example and with reference to the accompanying drawings in which FIG. 1 shows an embodiment of a bath incorporating an embodiment of a seat lift according to the present invention;

Figure 1:
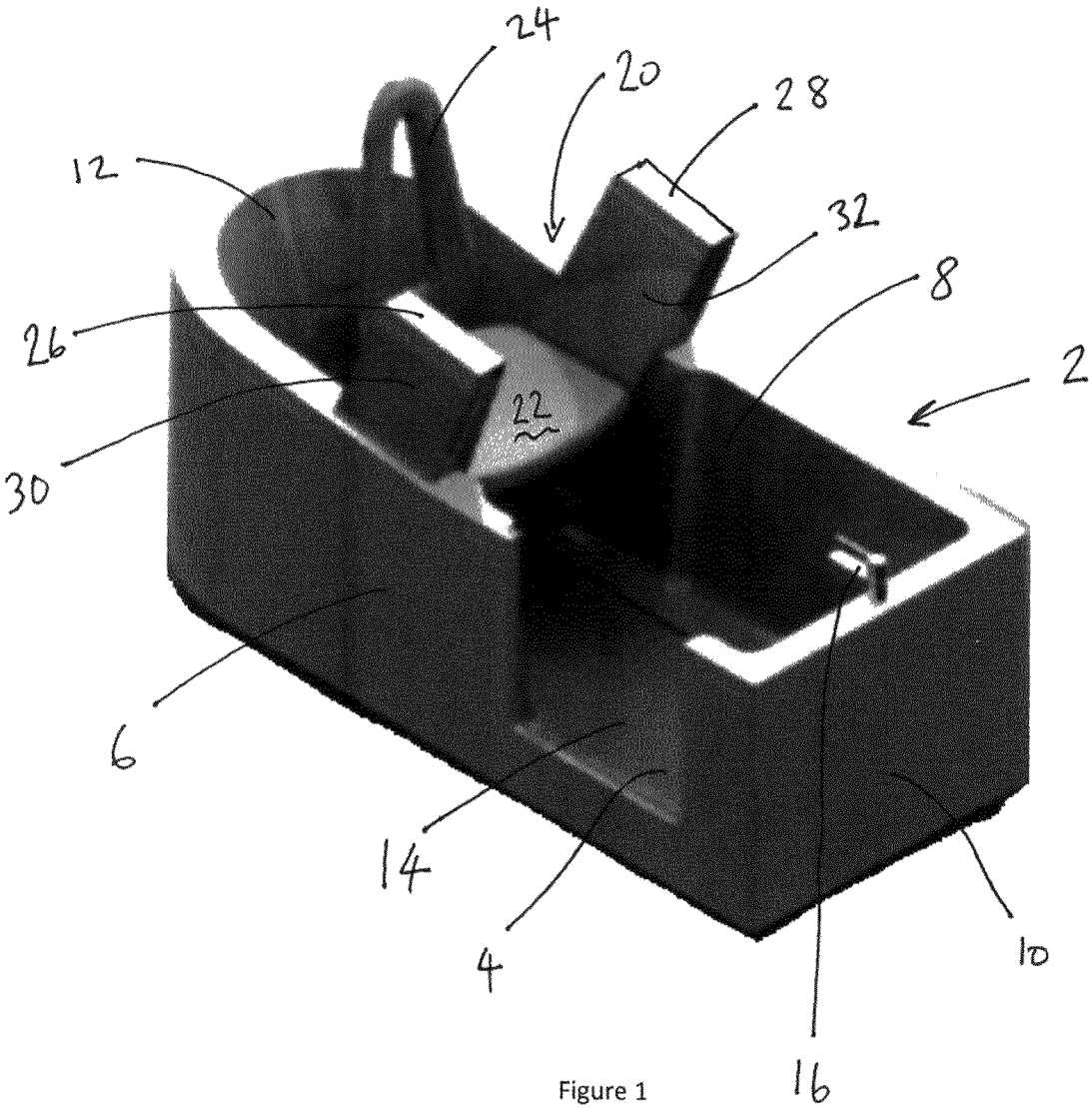

With reference to FIG. 1, there is shown a bath (2) comprising a bath base (4) and side walls (6), (8), (10) and (12). The side wall (6) includes an aperture (14) which may be sealingly closed by a door (not shown) so that the bath (2) can retain water introduced into it via a tap (16). The bath (2) is provided with a drain (not shown) through which water retained in the bath (2) may be removed from the bath if that is desired.

Integral with the bath (2) is a seat lift (20) comprising a seat (22), a seat back (24), and first and second armrests (26) and (28). The seat (22) and the armrests (26) and (28) are fixed to each other via arm pillars (30) and (32).

As shown in FIG. 1, the seat lift (20) is in its upper position, being a position when the seat lift (20) is furthest from the bath base (4) and, in particular, the seat (22) is sufficiently high above the bath base (4) that a user, including a user who is elderly, infirm or has mobility issues, can rest their hands or forearms on armrests (26) and (28) and sit upon the seat (22). The ability to rest their hands or arms on the armrests (26) and (28) is of significant benefit to the user because those armrests are sufficiently high that the user can use the armrests (26) and (28) to maintain stability when they sit on the seat (22).

Figure 2:
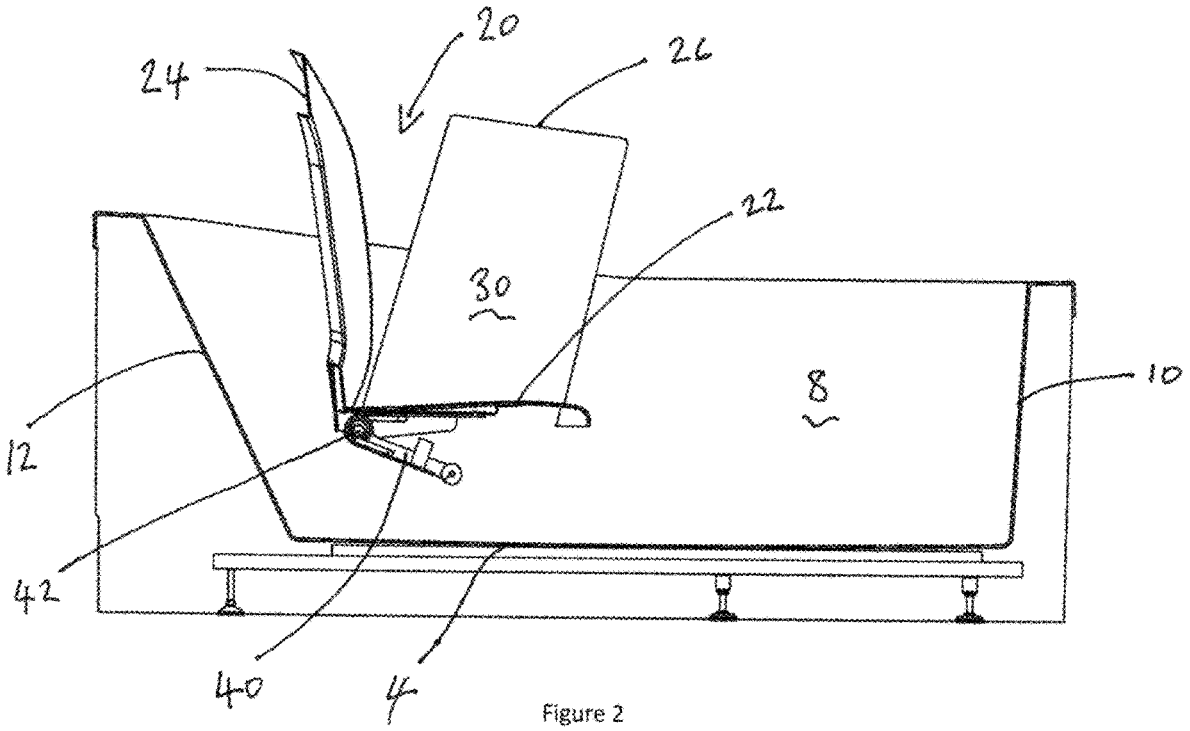
FIG. 2 shows a side view of a bath and seat lift as shown in FIG. 1 when the seat and seat back are in the upper position.

When the seat lift (20) is in the upper position as illustrated in FIG. 1, the seat back (24) is in the first seat back position, that seat back position being one in which the angle between the seat (22) and the seat back (24) is between about 90° and about 100° this is also illustrated in FIG. 2. The seat back (24) is biased by a torsion spring (44) into the first seat back position. The torsion spring exerts a torque of x Nm. When the seat lift (20) is in the lower position, the torsion spring exerts a torque of y Nm where x>y. This change of torque is caused by means not shown. In some embodiments of the invention the torsion spring (44) interacts with the bath base (4) to reduce the torque exerted by the tension spring (44) when the seat (22) is within a predetermined distance of the bath base (4).

Figure 2A:
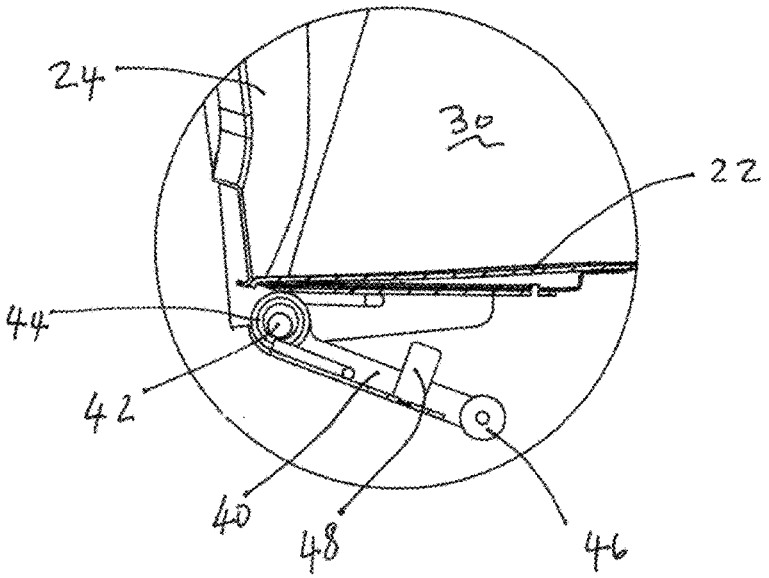
FIG. 2A shows a detail of FIG. 2.

As may be seen from FIGS. 2 and 2A, when the seat lift (20) is between the upper position (illustrated in FIG. 1) and a lower position (illustrated in FIGS. 3 and 3A) the seat back (24) remains in the first seat back position. This seat back position gives a user (not illustrated) a secure and stable seating position. The user may, via control means (not shown), cause the seat lift (20) to travel between the upper and lower positions.

As may be seen in FIGS. 2 and 2A, the seat lift (20) further includes a tilting lever (40). The tilting lever (40) is rigidly connected with the seat back (24) (although in alternative embodiments the seat back (24) and tilting lever (40) may be integral with each other) and the seat back (24) is hingedly attached to the seat (22) at a hinge (42). The hinge (42) is at least partially surrounded by a torsion spring (44) which acts on the tilt lever (40) biasing the tilt lever (40) in a clockwise direction as illustrated in FIGS. 2 and 2A. As a result, the torsion spring (44) also biases the seat back (24) into the first seat back position.

Figure 3:
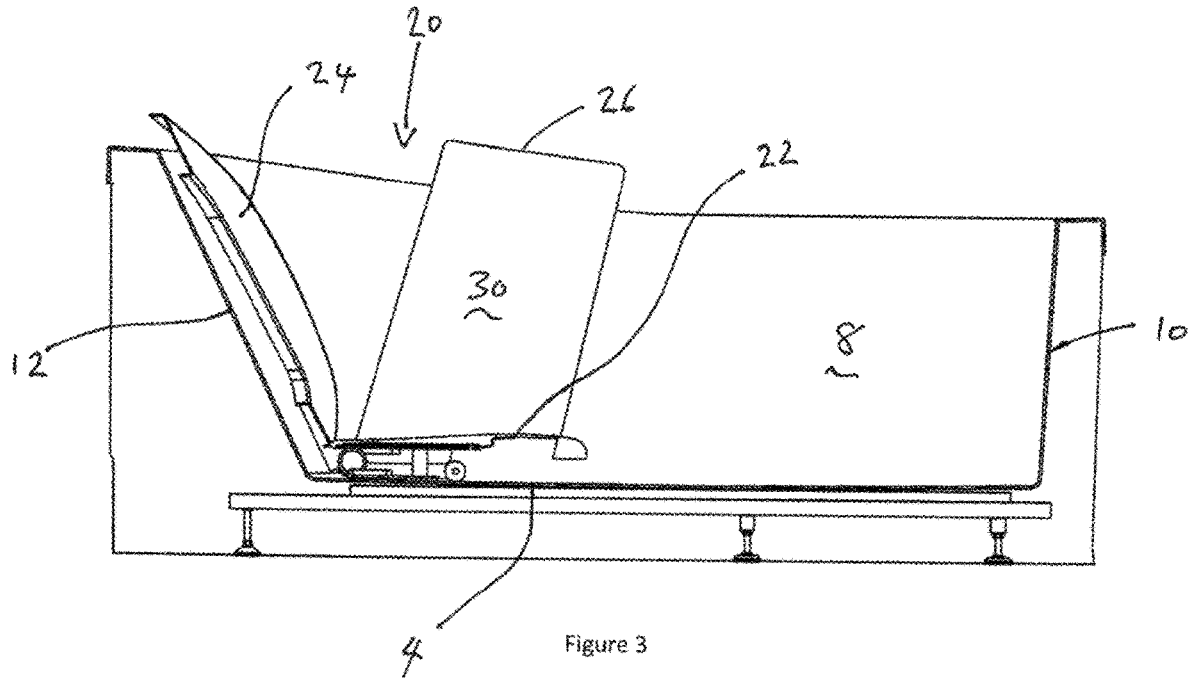
FIG. 3 shows a side view of bath and seat lift as shown in FIG. 1 when the seat and seat back are in the lower position.
Figure 3A:
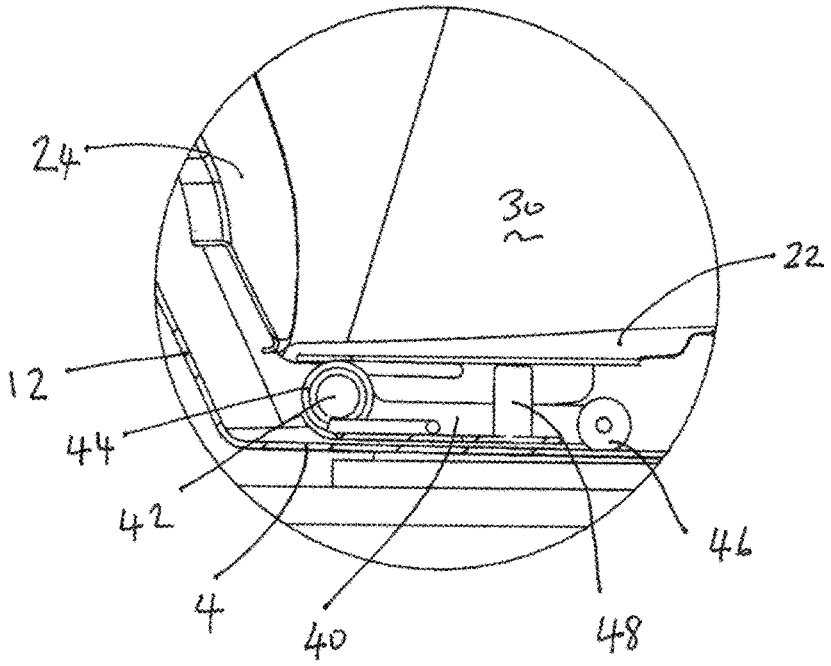
FIG. 3A shows a detail of FIG. 3.

When the seat lift (20) moves from the upper position downward and backward toward the bath wall (12) it moves towards the position illustrated in FIGS. 3 and 3A. As the seat lift (20) approaches the bath base (4) a roller (46) attached to the tilt lever (40) makes contact with the bath base (4) and rolls a small distance along the surface of bath base (4) as the tilt lever (40) is forced to rotate in an anticlockwise direction against the bias of the torsion spring (44). This anticlockwise movement of the tilt lever (40) causes the seat back (24) to move into to a second seat back position as illustrated in FIG. 3 wherein the seat back is proximal to the bath wall (12). This allows a user sitting on the seat (22) to be able to lie back to a certain degree and enjoy their bath.

The tilt lever (40) is provided with a stop (48) which, when the seat lift (20) reaches the lower position, bears upon the underside of the seat (22). This has the effect of preventing excess forces on the tilt lever (40) and renders the seat lift (20) more stable when in the lower position than it would otherwise be without the presence of stop (48).

When the seat lift (20) moves away from the lower position and toward the upper position the torsion spring (44) pushes the tilt lever (40) in a clockwise direction so moving the seat back (24) from the second seat back position toward the first seat back position.

Figure 4:
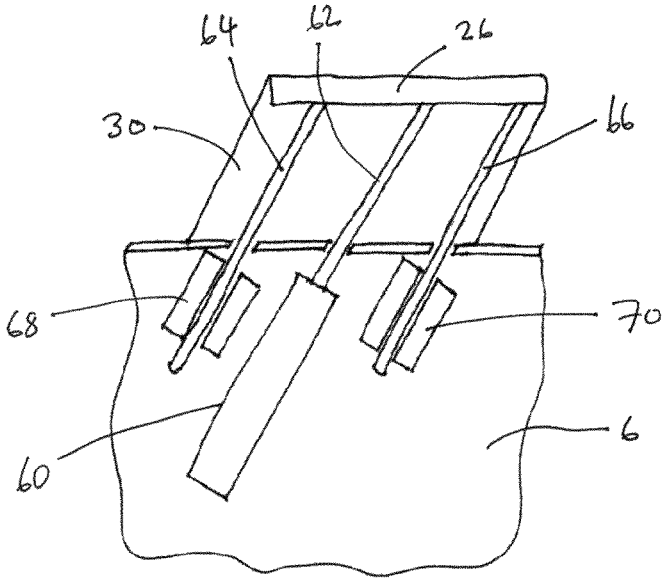
FIG. 4 shows a schematic detail for the guide means of the bath and seat lift as shown in FIG. 1.

The motive power for moving the seat lift (20) between the upper and lower position is provided by a pair of linear actuators (60) one of which is schematically illustrated in FIG. 4. The linear actuators (60) are electrically powered and controlled by control means that are not shown. Typically the control means would be incorporated in an armrest (26) or (28) or an arm pillar (30) or (32). Typically the control would be via rocker switches or the like.

The mechanism associated with movement of the seat lift (20) illustrated in FIG. 4 has an equivalent arrangement of actuator and stabilising rods associated with armrest (28) but which is not illustrated.

The linear actuator (60) is orientated at an angle relative to vertical with the result that when the actuator arm (62) either moves out of the actuator (60) or into the actuator (60) the armrest (26) upon which the actuator arm (62) bears moves away from the bath wall (12) or towards the bath wall (12) respectively. Alternatively expressed, the seat lift (20) moves along part of the longitudinal axis of the bath base (4) when the actuators (60) are in operation. Also provided are first and second stabiliser rods (64) and (66) which are attached to the armrest (26). A first end of stabiliser rods (64) and (66) pass through bushes (68) and (70) respectively. The bushes (68) and (70) are of a sufficient dimension in the direction of the longitudinal axis of the respective stabilising rods (64) and (66) that the bushes (68) and (70) have the effect of preventing lateral movement of the stabilising rods (64) and (66). This has the result that the armrest (26) is stable both whilst it is in movement as a result of operation of the actuator (60) and when the actuator (60) is not causing movement.

The actuator (60) and bushes (68) and (70) are fixed relative to the bath wall (6) by virtue of their attachment to a rigid bath frame (not shown) onto which the bath walls are also attached. This has the result that the armrests (26) and (28) are in a fixed stable position relative to the bath (2). For aesthetic reasons the bath walls (6) and (8) can be double skinned walls and the bath frame (not shown), actuators (60) and bushes (68) and (70) may be located between the skins. Also located between the skins may be appropriate power supply means and other electronics associated with the control of the movement of the seat lift (20).

The invention claimed is:

1. A seat lift for use in association with a bath comprising a bath base and at least one side wall, the seat lift comprising a seat, a seat back hingedly connected to the seat, a torsion spring, and a guide means adapted to guide the seat in reversible movement between a lower position in which the seat is close to the bath base and an upper position in which the seat is remote from the bath base characterized in that the guide means is configured so that movement of the seat between the lower and upper positions comprises both vertical and lateral movement of the seat relative to the base of the bath;

the seat back may move between a first seat back position in which the seat back is substantially upright and a second seat back position in which the seat back is orientated relative to the seat so that a user sitting on the seat and with their back on the seat back is leaning backwards;

the torsion spring biases the seat back to rotate around the hinge connecting the seat back to the seat toward the first seat back position; and a torque exerted by the torsion spring is smaller when the seat is in the lower position than when the seat is in the upper position.

2. A seat lift according to claim 1 in which the bath base has a longitudinal extent and the lateral movement of the seat is substantially in the direction of that longitudinal extent.

3. A seat lift according to claim 1 in which in first seat back position is such that the angle between the seat and the seat back is between around 90° and around 115°, between around 90° and around 110°, between around 95° and around 110°, or between around 100° and around 110°.

4. A seat lift according to claim 1 in which the second seat back position is such that the angle between the seat and the seat back is between around 115° and around 180°, between around 110° and around 180°, between around 110° and around 160°, or between around 110° and around 140°.

5. A seat lift according to claim 1 in which movement of the seat and seat back from the upper position to the lower position causes the torque exerted by the torsion spring to be reduced and movement of the seat and seat back from the lower position to the upper position causes the torque exerted by the torsion spring to increase.

6. A seat lift according to claim 5 in which the torsion spring interacts with the bath base when the seat is less than a predetermined distance from the bath base.

7. A seat lift according to claim 1 in which the torsion spring is a duel torsion spring.

8. A seat lift according to claim 1 in which the seat lift further comprises a tilting lever, in which the tilting lever is fixed to the seat back and a contact portion of the tilting lever extends below the seat.

9. A seat lift according to claim 8 in which the contact portion of the tilting lever is spaced from the seat when the seat back is in the first seat back position and movement of the contact portion of the tilting lever to move toward the seat causes movement of the seat back from the first seat back position toward the second seat back position.

10. A seat lift according to claim 8 in which the contact portion of the tilting lever may comprise one or more contact means adapted to contact the base of the bath without causing damage to the surface of the bath base.

11. A seat lift according to claim 1 in which the seat lift further comprises at least one arm rest.

12. A bath comprising a bath base and at least one side wall in combination with a seat lift according to claim 1.

* * * * *